United States Patent [19]

Medina et al.

[11] Patent Number: 5,067,328

[45] Date of Patent: Nov. 26, 1991

[54] COOLING VESSEL FOR BEVERAGES

[76] Inventors: Victor Medina; Rebecca Medina, both of 1300 N. 10th St., Poplar Bluff, Mo. 63901

[21] Appl. No.: 378,653

[22] Filed: Jul. 12, 1989

[51] Int. Cl.[5] ..... F25D 3/08

[52] U.S. Cl. ..... 62/457.2; 62/372; 62/430; 62/457.4

[58] Field of Search ..... 62/457.4, 372, 530, 62/430, 457.2

[56] References Cited

U.S. PATENT DOCUMENTS

| | | | |
|---|---|---|---|
| 2,039,736 | 5/1936 | Munters et al. | 62/457.4 X |
| 2,563,141 | 4/1950 | Vazzano | 62/457 |
| 2,805,556 | 9/1957 | Wang | 62/457.4 X |
| 3,161,031 | 12/1964 | Flannery | 62/457.4 X |
| 3,205,678 | 9/1965 | Stoner | 62/457 |
| 3,302,428 | 2/1967 | Stoner et al. | 62/457.4 |
| 3,680,330 | 8/1972 | Canosa | 62/457 |
| 3,715,895 | 2/1973 | Devlin | 62/457 |
| 4,183,226 | 1/1980 | Moore | 62/457 |
| 4,357,809 | 11/1982 | Held et al. | 62/457.4 |
| 4,402,195 | 9/1983 | Campbell | 62/457 |
| 4,620,426 | 11/1986 | Pitchford et al. | 62/530 X |
| 4,768,354 | 9/1988 | Barnwell | 62/457.4 |
| 4,782,670 | 11/1988 | Long et al. | 62/457.4 |

*Primary Examiner*—Lloyd L. King

[57] ABSTRACT

A cooling vessel for beverages that has an inner wall surrounded by an outer wall that is spaced therefrom to form a chamber that is filled with a refrigerant. The refrigerant functions to insulate the interior of the vessel from its outer walls, thus keeping its contents cold and keeping condensation off the outer surface of the vessel. The cooling vessel may be made of heavy plastic material that makes it unbreakable even after quick temperature changes. The cooling vessel may be designed to have the outer configuration of a mug, a glass, a pitcher, a baby bottle, etc.

3 Claims, 1 Drawing Sheet

COOLING VESSEL FOR BEVERAGES

BACKGROUND OF THE INVENTION

The invention relates to a drinking vessel for serving cold beverages such as beer, soft drinks, cocktails, iced tea, etc.

There are presently available on the commercial market various types of drinking and serving vessels which may be precooled and then used to chill beverages contained within them. Some of these vessels provide the necessary cooling effect by utilizing a refrigerant sealed within their exterior walls. There are, however, certain disadvantages common to most of the containers presently available. Two of these may be listed as follows:

(a) while the vessel is in use, condensation drippings, which collect on the exterior surfaces, are likely to run off the surface and cause damage to furniture or clothing of the users.

(b) in some cases, prior art vessels of the types described have a tendency to crack, causing the refrigerant to leak out.

It is an object of the invention to provide a novel cooling vessel for beverages that is economical to manufacture and market.

It is also an object of the invention to provide a novel cooling vessel for beverages that does not allow condensation to be formed on the outer surface of the vessel.

It is another object of the invention to provide a novel cooling vessel for beverages that is made of a heavy plastic construction which makes it unbreakable even after quick temperature changes.

It is a further object of the invention to provide a novel cooling vessel for beverages that can be configured in numerous shapes, such as mugs, glasses, pitchers, baby bottle, etc.

SUMMARY OF THE INVENTION

Applicant's novel cooling vessel for beverages has an outer wall and an inner wall that form a chamber between them into which is deposited a refrigerant such as blue ice. The refrigerant functions as insulation between the beverage and the outer surface of the drinking vessel. This allows the contents in the drinking vessel to be kept cold while keeping condensation off the drinking vessel's surface. Heavy plastic construction makes the drinking vessel unbreakable even after quick temperature changes.

The cooling vessels are normally kept in the freezer and when needed they are as cold as ice and stay cold longer than ice.

The cooling vessel can take the form of many different configurations. It may be a mug or a glass which has the beverage poured directly into its interior. A removable cover may be used with either of these embodiments. Also the cooling vessel may take the configuration of an insulated pitcher having an optional lid structure.

In other applications, the cooling vessel may take the form of a sleeve into which a beverage can or baby bottle can be inserted for keeping their contents cold. These structures may have a handle on them if so desired. Another embodiment would be a baby bottle having a hand gripping aperture formed in its central interior area.

DESCRIPTION OF THE PREFERRED EMBODIMENT

Figure 1:
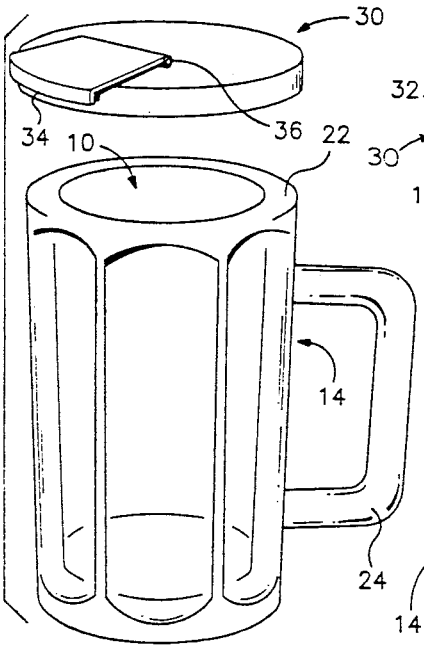
FIG. 1 is a front perspective view of applicant's novel cooling vessel in the form of a drinking mug and having a cover.
Figure 2:
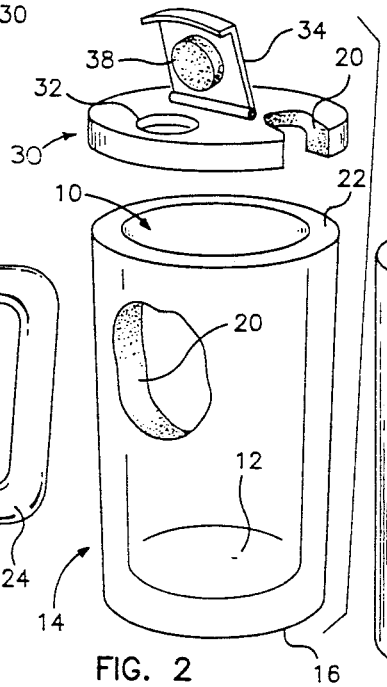
FIG. 2 is a front perspective view with portions broken away illustrating the cooling vessel in the form of a cup and having a removable lid.

Applicant's novel cooling vessel will be described by referring to FIGS. 1–7 of the drawing. The general structure of the vessels is similar in most of its embodiments. The vessels have a cylindrical member 10 having an open top and a bottom wall 12. An outer tubular member 14 surrounds cylindrical member 10 and it has a bottom wall 16. A freezable gelatin 20, such as blue ice is contained in the chamber formed between the cylindrical member 10 and outer tubular member 14. A top wall 22 covers the chamber and connects the inner and outer members. The embodiment in FIG. 1 has a handle 24.

Removable lid 30 has a pouring aperture 32. A tab member 34 has its bottom end secured to a hinge 36 attached to the top surface of lid 30. A rubber stopper 38 seals pouring aperture 32 when the tab member is pushed downwardly.

Figure 3:
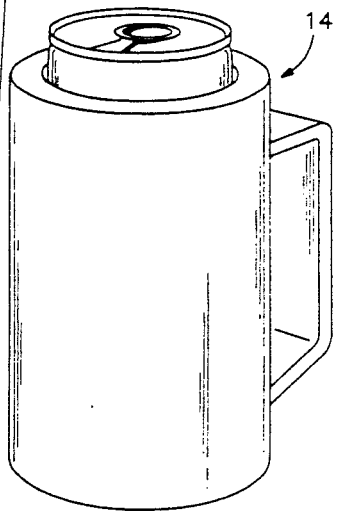
FIG. 3 illustrates the cooling vessel in the form of a sleeve which removably receives a can and which has a handle on its side.
Figure 4:
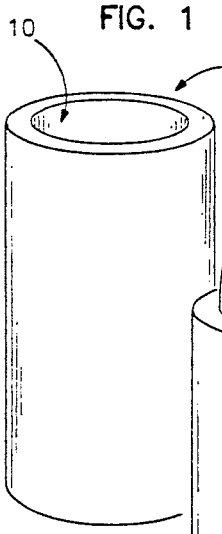
FIG. 4 is a front perspective view illustrating a cooling vessel in the form of a sleeve that does not have a handle.
Figure 5:
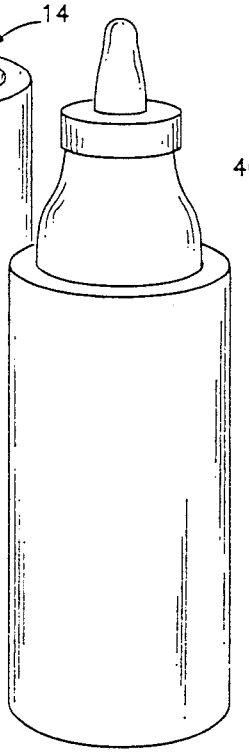
FIG. 5 is a front perspective view of the vessel illustrated in FIG. 4 with portions broken away and having a baby bottle inserted therein.

FIGS. 3–5 illustrate the cooling vessel as a sleeve into which a can or a baby bottle is removably inserted. One of the versions has a handle on its outer surface. The cooling vessel illustrated in FIG. 6 has the configuration of a pitcher having an optional lid.

Figure 7:
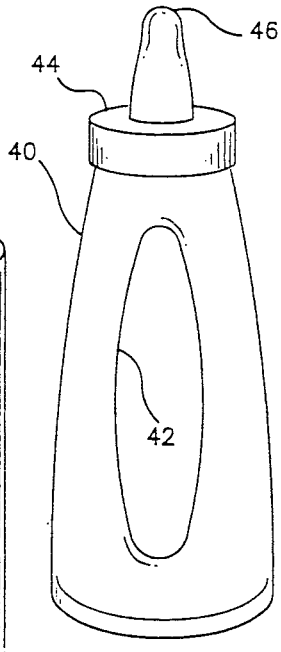
FIG. 7 is a front perspective view illustrating the cooling vessel in the form of a baby bottle having a centrally located hand gripping aperture.
Figure 6:
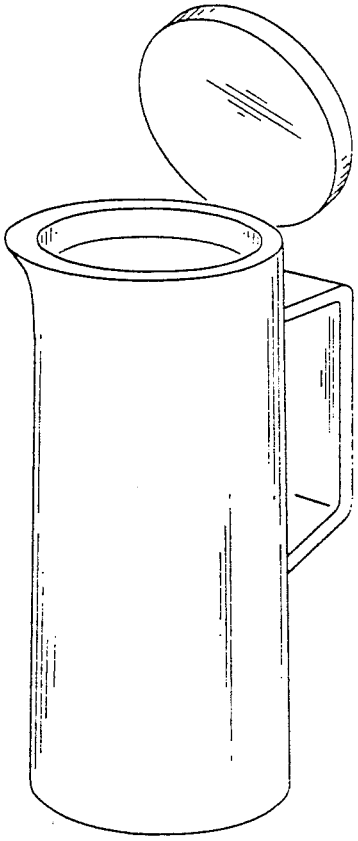
FIG. 6 is a front perspective view of the cooling vessel in the form of a pitcher having a lid.

A cooling vessel in the configuration of a baby bottle is illustrated in FIG. 7. It has a container housing 40 having a hand gripping aperture 42 formed in its central area. A cap 44 with a nipple 46 closes the top opening of the container housing.

What is claimed is:

1. A cooling vessel for beverages comprising:

a cylindrical member having an open top and a bottom wall that closes its bottom end, said cylindrical members having a predetermined outer diameter and a predetermined height;

an outer tubular member having a bottom wall, said outer tubular member having a height greater than that of said cylindrical member and an inner diameter greater than the outer diameter of said cylindrical member so that said cylindrical member can be inserted into said outer tubular member and be spaced from its respective walls thus forming a chamber surrounding the side walls and bottom wall of said cylindrical member;

a refrigerant filling said chamber between said cylindrical member and said outer tubular member, said refrigerant being a freezable gelatin such as blue ice;

an annular top wall connecting the top edge of said outer tubular member and the top edge of said cylindrical member; and a removable lid having a top surface spaced upwardly from a bottom surface to form a chamber that is filled with a freezable gelatin such as blue ice, said removable lid having a vertically oriented pouring aperture therein, a tab member having a front end, a rear end and a bottom surface, hinge means connecting the bottom end of said tab member to the top surface of said lid, a rubber stopper secured to the bottom surface of said tab member for closing said pouring aperture.

2. A cooling vessel for beverages as recited in claim 1 further comprising a handle attached externally to said outer tubular member.

3. A cooling vessel for beverages as recited in claim 2 wherein said vessel has the outer configuration of a beer mug.

* * * * *